US006231903B1

(12) United States Patent
Ji et al.

(10) Patent No.: US 6,231,903 B1
(45) **Date of Patent: *May 15, 2001**

(54) FOOD PACKAGE FOR MICROWAVE HEATING

(75) Inventors: Hong Ji, Woodbury; Randal J. Monforton, Eden Prairie, both of MN (US)

(73) Assignee: General Mills, Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,870

(22) Filed: Feb. 11, 1999

(51) Int. Cl.[7] ..... B65D 81/34; A23L 1/18

(52) U.S. Cl. ..... 426/107; 426/109; 426/118; 426/234; 426/403; 219/729; 219/730

(58) Field of Search ..... 426/107, 109, 426/111, 113, 115, 118, 126, 234, 243, 403; 219/728, 729, 730

(56) References Cited

U.S. PATENT DOCUMENTS

| | | | | |
|---|---|---|---|---|
| 3,219,460 | | 11/1965 | Brown | 99/192 |
| 3,985,991 | * | 10/1976 | Levinson | 219/105 E |
| 4,080,524 | | 3/1978 | Greenfield, Jr. et al. | 219/10.55 E |
| 4,081,646 | | 3/1978 | Goltsos | 219/10.55 E |
| 4,144,438 | | 3/1979 | Gelman et al. | 219/10.55 E |

(List continued on next page.)

FOREIGN PATENT DOCUMENTS 2098184 6/1997 (CA) .

0839 737 5/1998 (EP) ..... B65D/81/34

OTHER PUBLICATIONS

PCT International Search Report for PCT/US00/02020.
Article, "Better susceptor heats up for microwave pizza", Packaging Digest, Aug. 1995.
Article, "Historical and Recent Attempts to Solve Microwave Heating Problems with Packaging", vol. 13, No. 1—Summer 1992.
Article, "You can Use Metal In A Microwave Oven", Microwave World, vol. 13, No. 1—Summer 1992.
Article, "A Microwave Oven Model, Examples of Microwave Heating Computations", Microwave World vol. 19, No. 1—Summer 1998.
*Classical Electrodynamics* , John David Jackson, Second Edition, 1992, 1975; Chapter 8 "Wave Guides and Resonant Cavities", pp. 335–375; Sect. 9.11 "Simple Radiating Systems, Scattering, and Diffraction", pp. 438–441.
*Dielectrics and Waves* , Arthur R. Von Hippel, 1954, "Guided Waves", pp. 67–73.
*Microwave Cooking and Processing* , Charles R. Buffler, PhD, 1993, Chapter 7 "Packaging, Containers, and Susceptors", pp. 84–95.

*Primary Examiner*—Milton Cano
*Assistant Examiner*—Sherry A. Dauerman
(74) *Attorney, Agent, or Firm*—John M. Haurykiewicz; Douglas J. Taylor

(57) ABSTRACT

A food package and method of controlling heating of a foodstuff within the food package using microwave energy wherein the food package has a microwave shielding layer containing a plurality of apertures therein sized to permit penetration of evanescent microwave energy into the interior of the package with the microwave shielding layer being moved outward as the package expands due to generation of water vapor such that an interior volume of the package is subsequently protected against substantial microwave irradiation of the foodstuff upon and beyond completion of the microwave heating cycle.

30 Claims, 5 Drawing Sheets

U.S. PATENT DOCUMENTS

| | | | | |
|---|---|---|---|---|
| 4,190,757 | | 2/1980 | Turpin et al. | 219/10.55 E |
| 4,204,105 | | 5/1980 | Leveckis et al. | 219/10.55 E |
| 4,228,334 | | 10/1980 | Clark et al. | 219/10.55 E |
| 4,268,738 | | 5/1981 | Flautt, Jr. et al. | 219/10.55 F |
| 4,283,427 | * | 8/1981 | Winters et al. | 426/107 |
| 4,656,325 | | 4/1987 | Keefer | 219/10.55 E |
| 4,676,857 | | 6/1987 | Scharr et al. | 156/233 |
| 4,689,458 | | 8/1987 | Levendusky et al. | 219/10.55 E |
| 4,703,148 | | 10/1987 | Mikulski et al. | 219/10.55 E |
| 4,734,288 | | 3/1988 | Engstrom et al. | 426/107 |
| 4,777,053 | | 10/1988 | Tobelmann et al. | 426/107 |
| 4,810,844 | | 3/1989 | Anderson | 219/10.55 E |
| 4,865,921 | | 9/1989 | Hollenberg et al. | 428/461 |
| 4,866,234 | | 9/1989 | Keefer | 219/10.55 E |
| 4,870,233 | | 9/1989 | McDonald et al. | 219/10.55 E |
| 4,888,459 | | 12/1989 | Keefer | 219/10.55 E |
| 4,908,246 | | 3/1990 | Fredricks et al. | 428/34.1 |
| 4,927,991 | | 5/1990 | Wendt et al. | 219/10.55 E |
| 4,962,000 | | 10/1990 | Emslander et al. | 428/461 |
| 4,972,058 | * | 11/1990 | Benson et al. | 219/10.55 E |
| 4,972,059 | | 11/1990 | Wendt et al. | 219/10.55 E |
| 4,973,810 | * | 11/1990 | Brauner | 219/10.55 E |
| 4,985,606 | | 1/1991 | Faller | 219/10.55 E |
| 5,006,684 | | 4/1991 | Wendt et al. | 219/10.55 E |
| 5,012,068 | | 4/1991 | Anderson | 219/10.55 M |
| 5,038,009 | | 8/1991 | Babbitt | 219/10.55 E |
| 5,039,364 | | 8/1991 | Beckett et al. | 156/60 |
| 5,059,279 | | 10/1991 | Wilson | 156/651 |
| 5,081,330 | | 1/1992 | Brandberg et al. | 219/10.55 E |
| 5,117,078 | | 5/1992 | Beckett | 219/10.55 E |
| 5,124,519 | | 6/1992 | Roy et al. | 219/10.55 E |
| 5,164,562 | | 11/1992 | Huffman et al. | 219/10.55 E |
| 5,185,506 | | 2/1993 | Walters | 219/10.55 E |
| 5,221,419 | | 6/1993 | Beckett | 156/630 |
| 5,254,821 | | 10/1993 | Walters | 219/10.55 E |
| 5,256,846 | | 10/1993 | Walters | 219/10.55 E |
| 5,260,537 | | 11/1993 | Beckett | 219/10.55 E |
| 5,300,746 | | 4/1994 | Walters et al. | 219/745 |
| 5,331,135 | | 7/1994 | Ovadia | 219/728 |
| 5,354,973 | | 10/1994 | Beckett | 219/730 |
| 5,391,430 | | 2/1995 | Fabish et al. | 428/328 |
| 5,412,187 | | 5/1995 | Walters et al. | 219/728 |
| 5,413,757 | | 5/1995 | Kutner et al. | 422/21 |
| 5,468,939 | | 11/1995 | MacLean, IV | 219/727 |
| 5,473,142 | | 12/1995 | Mass | 219/727 |
| 5,489,766 | | 2/1996 | Walters et al. | 219/730 |
| 5,519,195 | | 5/1996 | Keefer et al. | 219/728 |
| 5,679,278 | * | 10/1997 | Cox | 219/730 |
| 5,928,555 | * | 7/1999 | Kim et al. | 219/729 |

* cited by examiner

FOOD PACKAGE FOR MICROWAVE HEATING

FIELD OF THE INVENTION

This invention relates to the field of microwave heating of foodstuffs, in particular to packaging designed for influencing the heating of the foodstuff as it is irradiated with microwave energy.

BACKGROUND OF THE INVENTION

With respect to microwave foods, it is often desirable that the microwave heating be controlled in order to prevent overheating of the food. One example is microwave heating and popping of popcorn. If popped kernels are subjected to prolonged microwave heating, scorching occurs. Currently, microwave popcorn is packaged in flexible paper bags. Embedded in the popcorn bag is a susceptor used to absorb microwave energy and aid popcorn heating and popping. Typically in packaging microwave popcorn, a slurry including popcorn kernels are located on top of the susceptor, the bag is folded over itself to a compact size. When the bag is placed in the microwave oven, instructions typically call for at least partial unfolding of the bag and placing the bag on a microwave transparent shelf or floor of the oven with the susceptor below the popcorn. When the popcorn bag is heated in the microwave oven, steam or water vapor from the popping popcorn causes the bag to further unfold and inflate. With the current bag designs, popped kernels are unprotected from microwave irradiation after popping. When heated above about 210° C., popped kernels begin to scorch. The present invention overcomes this shortcoming of prior art popcorn bags (and other microwave-related food packages) by providing a bag or package that initially exposes the unpopped popcorn (or other food load) to microwave irradiation to pop the kernels or otherwise heat the food load and thereafter protects the bulk of the popped kernels (or other heated food load) from microwave energy, thus reducing or eliminating the scorching (and other undesirable results of overheating) that would otherwise occur.

DETAILED DESCRIPTION OF THE INVENTION

Figure 1:
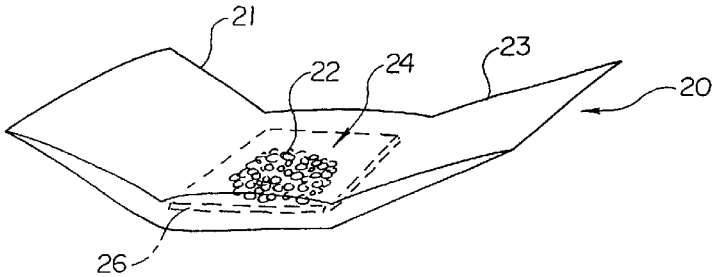
FIG. 1 is a perspective view of a popcorn bag useful in the practice of the present invention shown in a first state prior to popping under the influence of microwave irradiation.

Referring now to the Figures, and most particularly, to FIGS. 1, 2, 11, 12, 15 and 16, a food package 20 useful in the practice of the present invention may be seen. Food package 20 is in the form of a modified conventional microwave popcorn bag having wings 21, 23 in which the unpopped popcorn 22 is vended or sold for consumers to place in a microwave oven and pop the popcorn. It is to be understood that the unpopped popcorn load 22 typically will include fat, oil, salt, colorings, flavorings or the like in addition to the popcorn kernels, forming a mass or slurry 24, typically positioned on a microwave susceptor 26. Susceptor 26 may be a conventional susceptor as is well known to use for microwave heating, especially for popping popcorn.

Figure 5:
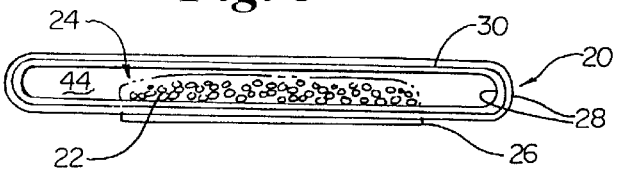
FIG. 5 is a schematic or simplified pictorial view of a generic version of the bag of FIG. 1 corresponding to the first state to illustrate certain features of the present invention.
Figure 6:
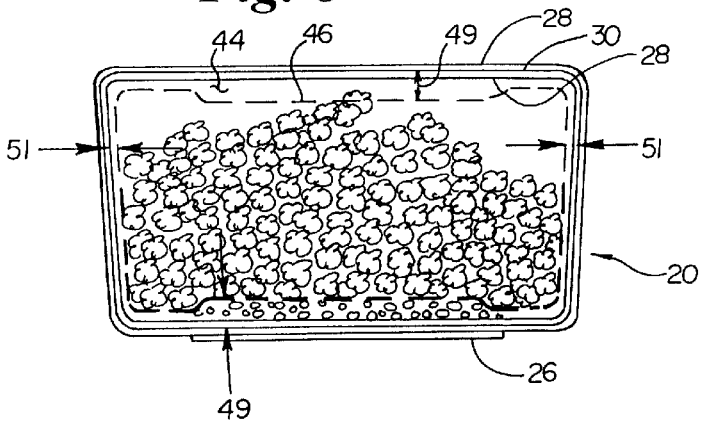
FIG. 6 is a schematic or simplified pictorial view of a generic version of the bag of FIG. 2 corresponding to the second state to illustrate certain aspects of the present invention

Referring now also to FIGS. 5 and 6, as well as the Figures already referred to, in this embodiment, the package 20 is preferably a flexible, inflatable bag. Bag or package 20 can be made from any desired material but is preferably formed of paper, one or more polymers, or a combination thereof, including but not limited to base coated paper or similar polymer structures or the like. It is to be understood that FIGS. 5 and 6 show an "idealized" package to illustrate certain aspects of the invention.

The package 20 preferably includes one or more septic layers 28 such as paper or plastic to provide a clean or sanitary environment and a suitable external appearance for the foodstuff during vending and handling. In addition, as part of the septic layer, (or as a separate layer) package 20 also has a water vapor barrier layer (e.g., interior layer 29) for reasons which will become apparent. It is to be understood that the water vapor barrier layer is desirably similar or identical to that used in conventional popcorn packaging intended for use heating in microwave ovens. It is to be further understood that this layer is sealed sufficiently to cause or allow the bag to inflate as is conventional in the microwave popping of popcorn, for reasons to be explained infra.

Figure 3:
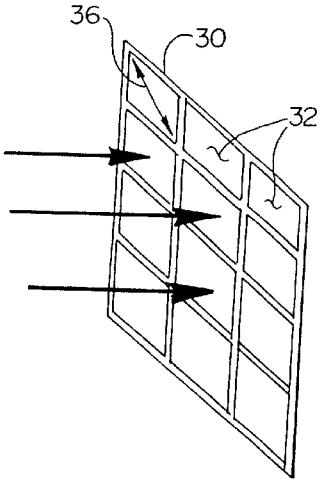
FIG. 3 is a simplified perspective view of a conducting sheet with apertures useful in the practice of the present invention.
Figure 4:
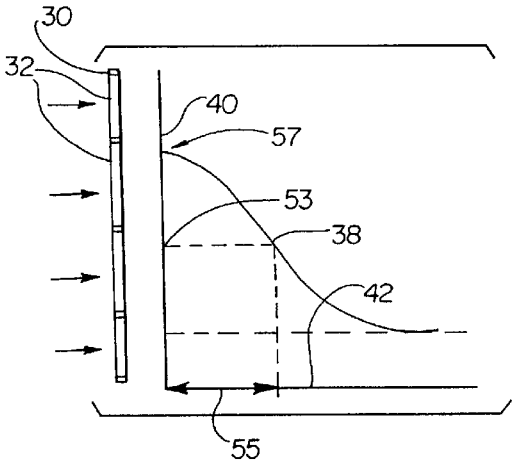
FIG. 4 is a side view of the perforated conducting sheet of FIG. 3, along with a simplified graph of evanescent microwave propagation power decay after microwave energy transits the sheet.

Unlike conventional packages for microwave popcorn, the package 20 of the present invention further includes a microwave shielding layer 30 which may be formed of metal. Referring now also to FIGS. 3 and 4, the microwave shielding layer 30 has a plurality of apertures 32 therein, with each aperture sized to permit substantially only evanescent or non-propagating microwave energy to enter the package. In the preferred embodiment, layer 30 is desirably thick enough to prevent the transmission of microwave energy therethrough {and is desirably thick enough to avoid layer 30 functioning (generally) as a susceptor}. It is believed that conventional susceptors are in the range of tens to hundreds of Angstroms in thickness. For conventional metals such as copper and aluminum (not acting as susceptors, but instead providing microwave shielding) the penetration depth is about a few microns.

The shape and size and pattern or lattice of the apertures are preferably chosen to limit transmission of microwave energy to substantially only an evanescent mode when the microwaves transit the layer 30. This is achieved primarily by maintaining the maximum dimension 36 of each aperture 32 to be sufficiently small to prevent transmission of propagating modes of microwave energy through layer 30. In comparison, and as a figure of merit, for a long waveguide with square cross section, the microwave energy is limited to an evanescent mode when:

$$a<\lambda/2 \tag{1}$$

where "a" is the linear dimension of the waveguide cross section, and $\lambda$ is the free space wavelength.

In general in the prior art, "evanescent mode" has been used to refer to operation below cutoff, i.e., $\lambda>\lambda_c$, where $\lambda_c$ is the cutoff wavelength, and the guide wavelength $\lambda_g$ is given by Equation (2):

$$\lambda_g=\lambda_0/(1-\nu^2)^{1/2} \tag{2}$$

where $\nu$ is the normalized wavelength, given by Equation (3) as the ratio of the wavelength of interest, $\lambda$, to the cutoff wavelength:

$$\nu=\lambda/\lambda_c \tag{3}$$

The free space wavelength is about 12.24 cm for 2450 MHz. As used herein, the term "evanescent" is believed to be consistent with, but an extension of, the use of that term in the prior art. Typically, in a microwave oven, the cavity is "overmoded," unlike conventional waveguide operation. Since the food package of the present invention is exposed to the overmoded field in order to carry out the present invention, the term "evanescent" here is used by analogy or extension to prior art use and refers to decaying, as opposed to propagating microwave energy passing through the grid or aperture pattern of the microwave shielding layer 30.

Returning again to conventional prior art systems, below cutoff, the microwave energy decays generally exponentially with a depth of penetration 49 given by Equation (4):

$$D_p=(a/2\pi)[1-(2a/\lambda)^2]^{-1/2} \tag{4}$$

As is illustrated generally in FIG. 4, the microwave power transiting sheet or layer 30 having apertures 32 therein is evanescent when the maximum dimension of the apertures 32 is below a length permitting propagating power to pass through such apertures. For square or rectangular apertures, the maximum dimension is a diagonal 36. For apertures of other geometries, the maximum dimension is characteristically the longest "free" dimension of the aperture, e.g., for an ellipse, the chord through the two vertices (along the major axis) is the maximum dimension. Curve 38 is an illustration of the power decay of evanescent microwave energy plotted with energy on the ordinate axis 40 and distance from the layer 30 along the abscissa 42. It is to be generally understood, that the smaller the maximum dimension of the apertures, the more rapid the power decay, provided that other design parameters are held constant. The evanescent mode of microwave energy transiting the apertured layer 30 will form a spatially limited zone of microwave energy beyond the outer surface of layer 30. The depth of the zone beyond the layer 30 can be adjusted by varying the dimensions (especially the maximum dimension) of the apertures in the layer, or by adjusting the shape or pattern of the apertures. In the practice of the present invention, apertures 32 in layer 30 create a spatially controlled "penetration zone" 44 (see FIGS. 5 and 6) for microwave heating within package 20.

In FIG. 5 it will be noted that when the package or bag 20 is collapsed in its initial configuration, the penetration zone may extend substantially across the entire interior of the package, thus permitting microwave irradiation both from above and below, in effect providing an "overlap" of the penetration zone extending down from the top layer with the penetration zone extending up from the bottom layer. In the alternative, the upper and lower penetration zones may abut each other, or it may be desirable (for other reasons) to have the penetration zones not overlap, e.g., in the event the food load is desirably or necessarily thicker than the sum of the depths or thicknesses the desired penetration zones.

In FIG. 6, with the bag expanded or inflated, the penetration zone 44 extends only a predetermined, limited distance within layer 30, with the boundary of the penetration zone 44 indicated by dashed line 46. In the idealized images shown in FIGS. 5 and 6, it is to be understood that apertures 32 extend across substantially all of the surface of layer 30 of package 20.

Figure 11:
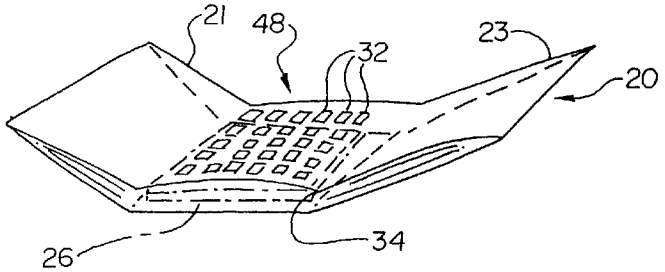
FIG. 11 is a view similar to FIG. 1, except that the popcorn bag is generally enclosed by a microwave shielding layer with apertures only in a limited region thereof and with the unpopped popcorn load omitted for clarity.
Figure 12:
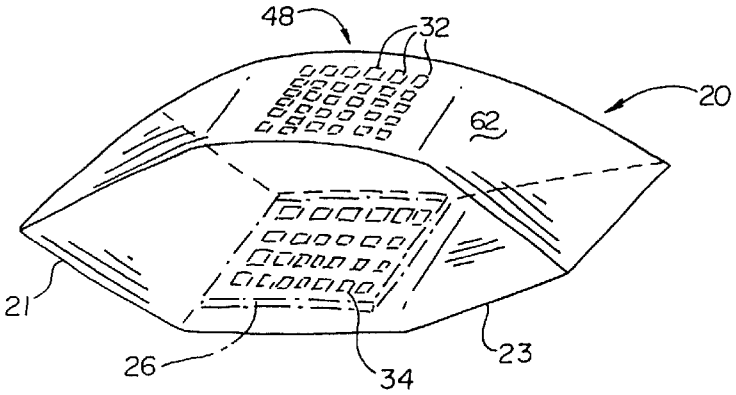
FIG. 12 is a view according to FIG. 1, except showing the popcorn bag in the second state and with the popped popcorn load omitted for clarity.

While the pattern of apertures 32 may extend across the entire package (as is illustrated in an alternative embodiment in FIGS. 8 and 9), alternatively, the microwave shielding layer 30 may extend across substantially all of the surface 62 of the food package 20, with one or more patterns of apertures 32 extending across only one or more predetermined, limited regions, for example, a region made up of sub-regions 34, 48 of the food package 20, as is shown in FIGS. 11 and 12. As a still further embodiment, various regions may have different sized or shaped or spaced apertures to selectively control the microwave energy passing through layer 30 and into the interior of package 20. To that end, it has been found that altering the spacing between apertures can be used for such microwave energy control. Furthermore, it has been found that using a regular lattice i.e., one having constant spacing between apertures and between the rows and columns of apertures, is the most restrictive to the passage of microwave energy through the grid of layer 30. As used herein, it is to be understood that "lattice" refers to the geometrical arrangement of apertures, particularly the spacing between adjacent rows or columns (or both) of the apertures 32 in layer 30.

Figure 14:
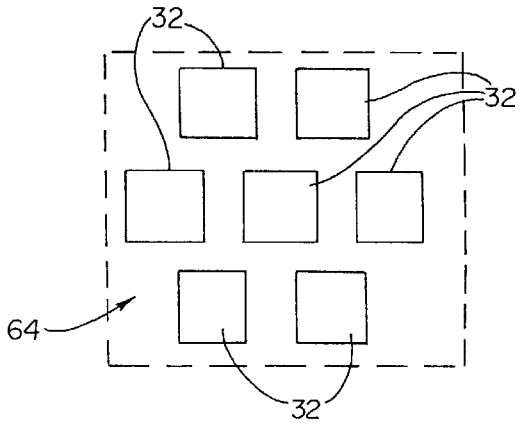
FIG. 14 is a plan view of an alternative lattice arrangement for an aperture pattern useful in the practice of the present invention.

It is to be understood that it is within the scope of the present invention to use offset lattices in the practice of the present invention. Such offset lattices can be periodic or non-periodic, and different regions of the microwave shielding layer can have different lattice arrangements in addition, or as an alternative, to changing the shape and size of individual apertures. In FIG. 14, a triangular lattice 64 is formed by the pattern of individual apertures 32, and is illustrative of an alternative to the regular lattice or pattern of apertures shown with respect to the earlier Figures. It is also within the scope of the present invention to use other aperture shapes in such alternative lattice arrangements, as well.

Figure 13:
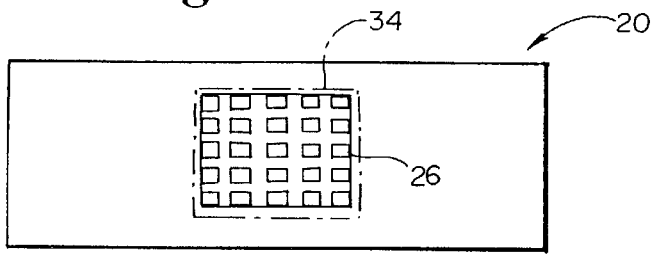
FIG. 13 is a bottom plan view of the bag of FIG. 12 in the second state.

Turning now to the embodiment shown in FIGS. 11, 12 and 13 (which correspond to the embodiment of FIGS. 1 and 2), the evanescent mode microwave energy penetrates layer 30 in an upper surface only in a region 48 corresponding to the food load 22. At the same time, microwave energy is continuously applied through region 34 of a lower surface to heat the food load 22. In this embodiment, package 20 thus includes a predetermined region containing the plurality of apertures that includes both isolated sub-regions 48 and 34 on more than one surface of the food package or bag 20. Initially, in this embodiment, the predetermined region is preferably generally congruent to the food load 24 as it exists prior to being heated. As the food load 24 is heated, the bag 20 inflates due to the steam or water vapor generated by the popcorn popping, moving region 48 away from the food load 22, thus limiting penetration of microwave energy through apertures 32 to a penetration zone adjacent the interior of region 48. In this embodiment, the popped popcorn will be shielded by layer 30 from further exposure to microwave energy while the food load 22 will be continuously exposed through sub-region 34 to the microwave energy to complete popping. Furthermore, gravity will move the popped kernels away from the sub-region 48, even though continued popping will jostle the popped kernels. Referring now again to FIG. 6, the depth 49 of the penetration zone 44 can be controlled and varied from place to place along the bag or package 20 (or 50) by using different sizes or shapes or numbers or spacing of apertures 32 in different sub-regions of layer 30 around the bag 20. For example, and not by way of limitation, penetration zone 44 can have a depth of penetration or thickness of ¼ inch adjacent sub-regions 48 and 34, and a lesser depth of penetration 51 of ⅛ inch in the remainder of the interior of the food package 20. Referring now again to FIG. 4, the example numerical values for the depths of penetration 49, 51 are relative figures of merit, for example, and not by way of limitation, the half-power points corresponding to distance 55 away from ordinate axis 40 (representing the outer surface of layer 30) where level 53 is one half the peak power 57 of curve 38.

Figure 2:
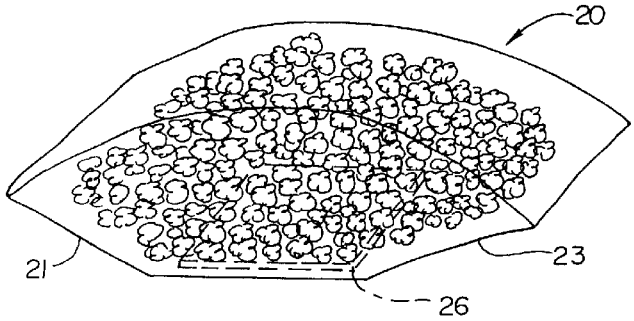
FIG. 2 is the popcorn bag of FIG. 1 shown in a second state with a substantial amount of popcorn popped.
Figure 15:
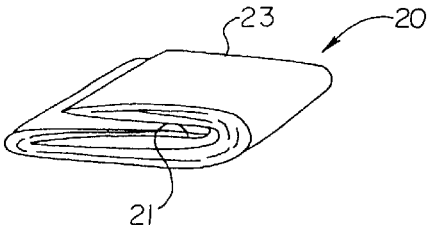
FIG. 15 is a perspective view of the popcorn bag of the embodiment of FIG. 1 shown in an a completely folded state.
Figure 16:
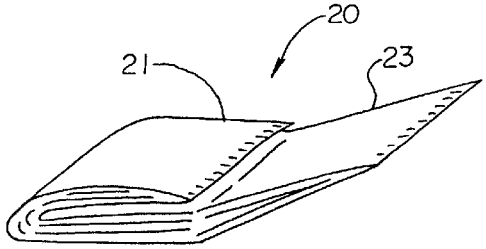
FIG. 16 is a perspective view of the popcorn bag of FIG. 15 shown in a partially unfolded state.

Referring now most particularly to FIGS. 15 and 16, the embodiment of FIGS. 1 and 2 is shown in fully folded and partially folded configurations. FIG. 15 shows bag or package 20 with first and second wings 21, 23 in a fully folded configuration. FIG. 16 shows bag 20 in a partially folded configuration with wing 21 folded and wing 23 unfolded. It is to be understood that bag 20 is preferably fully folded when packed for shipment and sale. In the practice of the present invention, bag 20 may be placed in a microwave oven fully or partially folded, or fully unfolded (as illustrated in FIGS. 1 and 11) prior to exposure to microwave irradiation. However, it is preferred that the bag 20 be fully unfolded as shown in FIG. 1 prior to microwave irradiation. As with conventional bags, if a susceptor 26 is used, bag 20 is preferably oriented with the surface containing the susceptor located on the bottom.

The present invention, in the embodiments shown, provides a bag for reducing scorching while still enabling popping of popcorn, or popping, puffing, or otherwise heating other foodstuffs, by allowing significant penetration of microwave energy into the bag, delivering sufficient energy to pop the popcorn while the bag is in a collapsed or folded condition. After popping has inflated the bag, the majority of the food package interior (i.e., the region beyond, or interior of, the penetration zone) is protected from further entry of significant microwave energy. This is accomplished by selecting one or more sizes of apertures 32 to permit passage of substantially only evanescent (i.e., non-propagating) microwave energy modes into the interior of the bag. In the practice of the present invention wherein the susceptor 26 is interior of layer 30, there is preferably a region 34 in layer 30 on the bottom surface of the package 20 at least substantially congruent to the susceptor 26 to permit microwave energy to reach and heat the susceptor 26 as the energy enters from the bottom of the package. If susceptor 26 is located exterior of layer 30, it may still be preferable to have a grid or perforated region 34 on the bottom of the package to enable microwave energy to pass through susceptor 26 and heat the food load located inside the package. In either event, the lattice or grid of region 34 is desirably arranged to prevent entry of microwave energy other than evanescent mode energy into the interior of package 20. This may be accomplished by providing a pattern of apertures 32 adjacent to the susceptor 26. It is to be understood that the susceptor 26 may be located interior or exterior of the microwave shielding layer 30, (or even may be omitted) as desired.

Figure 7:
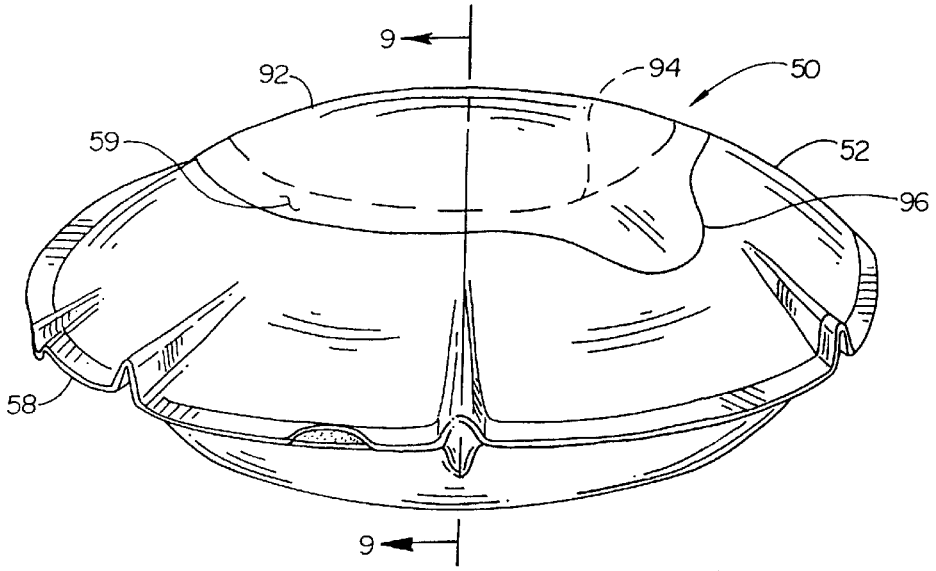
FIG. 7 is a perspective view of an alternative embodiment of a package useful in the practice of the present invention and shown in an expanded condition.

Referring now to FIGS. 7 through 10, an alternative embodiment of the present invention may be seen. In FIG. 7, the package 50 of this embodiment is shown in an expanded condition. The package or bag 50 is generally circular in plan as may be seen most clearly in FIG. 8. As with the previously described embodiment, bag 50 is preferably formed of a flexible, but non-extendable material such as paper or similar cellulose material 52, with a microwave shielding or reflective layer 54 laminated thereto. The various panels or walls making up bag 50 are preferably sealed to trap the water vapor created within the bag 50 during microwave heating thereof, while at the same time allowing selective rupture when desired to permit access to the interior of the bag when the food is to be consumed. It is preferred to provide an annular adhesive strip 56 to secure the walls of bag 50 together, using heat and or pressure.

Figure 8:
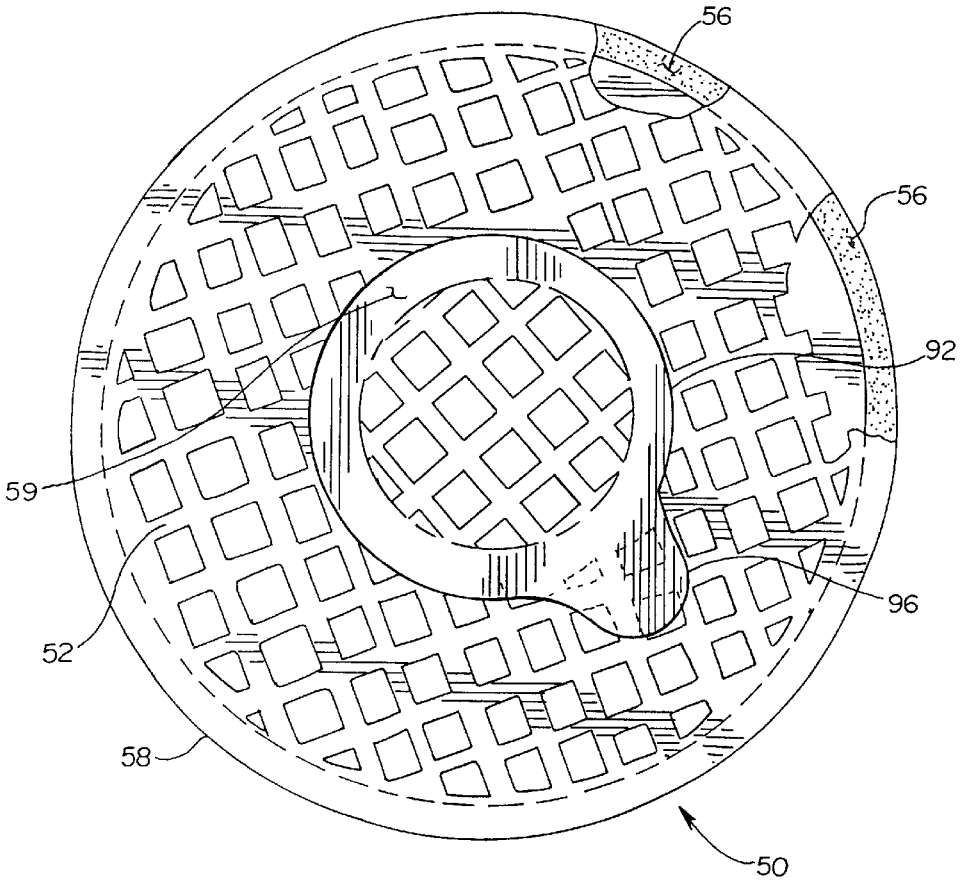
FIG. 8 is a top plan view of the package of FIG. 7 illustrating a microwave shielding layer with apertures therein in an unfilled, flat condition, with portions broken away.
Figure 9:
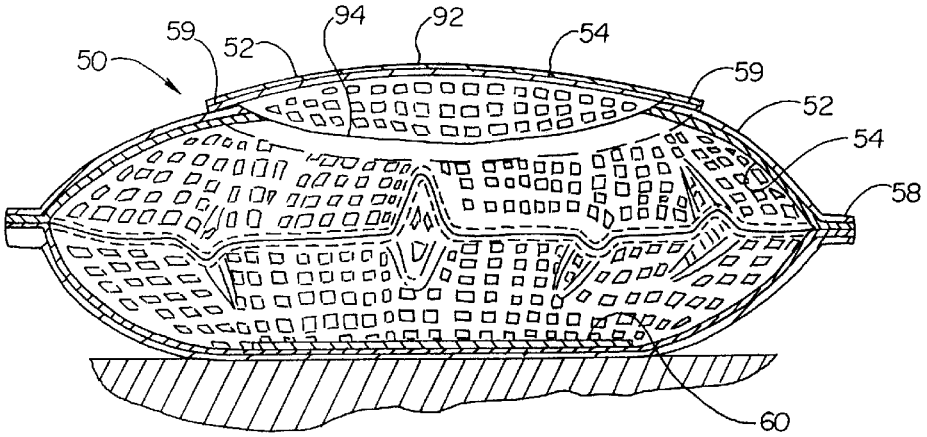
FIG. 9 shows a cross sectional view of the package of FIG. 7 according to section line 9—9 of FIG. 7, with the popped popcorn removed and the microwave shielding layer with apertures therein shown for illustration.

It is to be understood that it is preferable to form bag 50 as a generally planar assembly when collapsed. FIGS. 8 and 9 illustrate that the microwave shielding layer 54 is perforated with apertures 32 across substantially all of the surface thereof, with the possible exception of the adhesively secured seams 58 and 59. As in the first embodiment, it is to be understood that the microwave shielding layer may be invisible to a consumer user, being laminated between other layers forming a sanitary or septic food package. In FIG. 9 a susceptor 60 is shown, preferably secured to bag 50. As with the first embodiment, susceptor 60 can be exposed to the full effect of microwave irradiation by being located exterior of the microwave shielding layer 54, or it may be attached interior of the apertured microwave shielding layer 54. Bag 50 is preferably loaded with a charge of unpopped popcorn, and fat or oil, with flavorings and colorants optionally included. Bag 50 is preferably folded into a generally rectangular configuration for shipping and vending, and, in its folded configuration, may be of a size and shape similar to the first embodiment or other conventional microwave oven ready popcorn packages.

Figure 10:
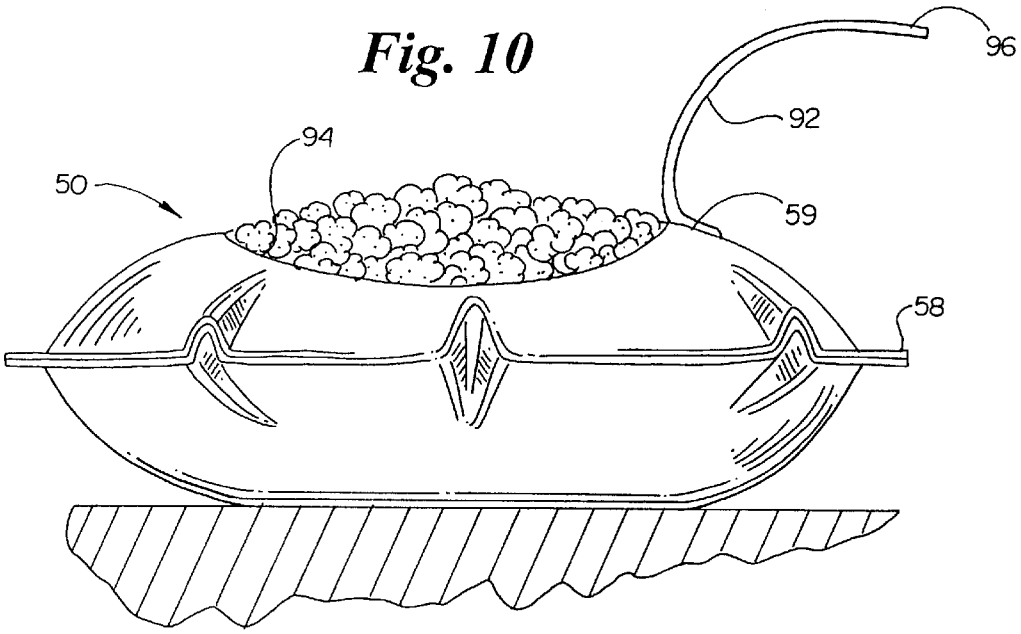
FIG. 10 shows a side view of the package of FIG. 7 in an opened condition.

Bag 50 also preferably has a removable cover 92 overlapping an opening 94 in the upper surface thereof Cover 92 preferably has an adhesive seam 59 which is openable by a consumer once the popcorn is popped, as is illustrated in FIG. 10. A non-adhered flap 96 preferably is formed integrally with cover 92 to assist in opening the bag 50. It is to be understood that cover 92 may have an aesthetically pleasing outer layer 52 formed, for example of a heat stable polymer or paper and an inner microwave shielding layer 54, with apertures therein, as is illustrated in FIGS. 8 and 9.

It is to be understood that the contents of the food package of the present invention may be popcorn kernels or any suitable grain such as rice, maize, barley, sorghum, or the like for being popped or puffed when heated or reheated in a microwave oven.

When subjected to microwave heating, the susceptor will convert microwave energy to heat, and the food load will be subjected to direct heating until sufficient water vapor is released to expand the bag sufficiently to move the upper apertured microwave layer away from the food load by a distance greater than the depth of penetration of the evanescent microwave energy. As popping or puffing continues, the food package will inflate or expand further, enlarging the volume protected from substantial microwave irradiation interior of the penetration zone. It is to be understood that the penetration zone extends substantially across the entire interior surface of package 50. Nevertheless, the protected volume will eliminate scorching of the popped popcorn therein, and the jostling of the popped popcorn will constantly move peripheral popped kernels into and out of the penetration zone, further reducing the chance of scorching.

The grid pattern for square apertures in the practice of the present invention is preferably in the range of ½ to 1½ inches in linear dimension (the length of each side of an aperture). In order to create evanescent microwave energy interior of the microwave shielding layer, the thickness and width of the grid pattern forming the apertures must be greater than the penetration depth $\delta$ of the conducting material. For a material of conductivity $\sigma$, the penetration depth is given by Equation (6):

$$\delta = c/(2\pi\sigma\omega)^{1/2} \quad (6)$$

where c is the speed of light, and $\omega$ is the microwave (radian) frequency. The width of the grid between apertures should not be so great as to prevent formation of significant evanescent waves interior of the microwave shielding layer to heat the food.

For this reason, the width of the grid is desirably greater than the penetration depth (a few microns, depending on material) and less than ⅜ inches. It is to be emphasized that the shape of the apertures can be regular or irregular, and can include, but is not limited to square, triangular, round, elliptic and even irregular or amorphous (if limited in its maximum dimension to achieve the evanescent microwave mode). The grid or aperture pattern can be regular across the surface of the package or it can be interrupted or irregular, as desired to achieve the proper heating effect for the particular food load carried by the package. The microwave shielding layer can be formed of any material capable of reflecting microwave energy, including, but not limited to, most metals and alloys, such as aluminum, nickel, copper, silver, iron, stainless steel, and the like.

The amount of microwave energy entering the food package can be controlled by varying the parameters of the apertures 32, the grid bridge 72, the thickness 82 of sheet 70 making up microwave shielding layer 30 in food package 20, and the pattern (or lattice type) of the apertures 32. It is to be understood to be within the scope of the present invention to vary (or hold constant) one, some or all of these parameters across the surfaces of the food package to obtain desired results by controlling the evanescent microwave energy entering the food package. This is true notwithstanding whether or not additional, non-evanescent microwave energy also enters the food package, provided that the food load is primarily influenced by the evanescent microwave energy at least in the regions where the present invention is being practiced.

It is to be further understood that the present invention is suitable for selective heating of foods other than popcorn and other puffed foodstuffs. For example, and not by way of limitation, a filled pastry that gives off water vapor when heated, may be heated and a topping such as frosting may be melted using a food package according to the teachings of the present invention. In such an application, the filling may be prevented from being overheated (to avoid scalding a consumer) while the outer surface of the foodstuff can be heated and even browned, if desired, using the penetration zone of the present invention to selectively heat the foodstuff, and prevent overheating by inflation of the package during microwave irradiation.

As another example, and not by way of limitation, the present invention may be used to selectively and controllably heat or cook a pizza using microwave irradiation, where the food package for the pizza may have relatively small apertures in a lower surface to admit evanescent energy only (or primarily) to the pizza crust below the toppings while the upper grid or region above the pizza food load may have apertures suitable for sufficient, but not excessive, heating or cooking of the toppings, followed by a movement of the upper grid away from the pizza (as a result of the water vapor generated) to prevent overheating of the toppings. This approach may be utilized with or without a susceptor to achieve desired browning of the crust, and to simultaneously achieve desired cooking of the toppings, without overcooking.

The invention is not to be taken as limited to all of the details thereof as modifications and variations thereof may be made without departing from the spirit or scope of the invention.

What is claimed is:

1. A food package for controlling heating with microwave energy comprising:

a. a microwave shielding layer with a plurality of apertures therein prior to exposure to microwave energy, with the apertures sized to permit substantially evanescent penetration of microwave energy into an interior of the package during microwave heating;

b. a foodstuff contained in the food package with the foodstuff initially located in close proximity to the microwave shielding layer; and c. means for moving the microwave shielding layer away from close proximity to the foodstuff after the package and the foodstuff is irradiated with microwave energy such that the evanescent penetration of the microwave energy is insufficient to over heat the foodstuff when the microwave shielding layer is moved out of close proximity to the foodstuff.

2. The food package of claim 1 wherein water vapor is generated by the microwave energy and the means for moving the microwave shielding layer away from close proximity the foodstuff is a water vapor barrier layer operative to inflate the package in response to the generation of water vapor.

3. The food package of claim 2 wherein the foodstuff is popcorn.

4. The food package of claim 1 wherein the food package further comprises a microwave susceptor located interior of the microwave shielding layer.

5. The food package of claim 1 wherein the food package further comprises a microwave susceptor located exterior of the microwave shielding layer.

6. The food package of claim 1 wherein the food package further comprises a septic layer located adjacent the microwave shielding layer.

7. The food package of claim 1 wherein the plurality of apertures extend substantially across the entire food package.

8. The food package of claim 1 wherein the plurality of apertures extend across a predetermined, limited region of the food package.

9. The food package of claim 8 wherein the limited region is aligned with the foodstuff as it exists prior to heating.

10. A method of controlling heating of a foodstuff with microwave energy comprising the steps of:

a. providing a food package having a microwave shielding layer with a plurality of apertures therein prior to exposure to microwave energy, where the apertures are sized to permit substantially evanescent penetration of microwave energy into the interior of the package;

b. initially locating a foodstuff within the food package in close proximity to the microwave shielding layer;

c. irradiating the package and foodstuff with microwave energy; and d. moving the microwave shielding layer away from close proximity to the foodstuff after the package and the foodstuff is irradiated with microwave energy such that the evanescent penetration of the microwave energy is insufficient to over heat the foodstuff when the microwave shielding layer is moved out of close proximity to the foodstuff.

11. The method of claim 10 wherein water vapor is generated by the microwave irradiation.

12. The method of claim 11 wherein the water vapor expands the package to move the microwave shielding layer away from close proximity to the foodstuff after the package and the foodstuff is irradiated with at least a predetermined amount of microwave energy.

13. The method of claim 12 wherein the foodstuff is popcorn.

14. The method of claim 10 wherein the step of providing a plurality of apertures in the microwave shielding layer further comprises locating the plurality of apertures in a predetermined region of the food package.

15. The method of claim 14 wherein the step of providing a plurality of apertures in the microwave shielding layer further comprises locating the plurality of apertures aligned with the foodstuff as it exists prior to heating.

16. The method of claim 10 wherein step a further comprises providing the plurality of apertures across substantially all of the food package.

17. The method of claim 10 further comprises providing a susceptor in the food package, wherein the microwave shielding layer has apertures adjacent the susceptor.

18. The method of claim 10 wherein step a further comprises providing the food package with a water vapor barrier layer.

19. The method of claim 10 wherein step a further comprises providing the food package with a septic layer sufficient to maintain a sanitary environment for the interior of the food package.

20. A microwave popcorn package for popping popcorn in a microwave oven comprising:

a. a bag having:

i. a microwave shielding layer with a plurality of apertures therein prior to exposure to microwave energy with the apertures sized to permit substantially evanescent microwave energy to enter the interior of the bag, and ii. a water vapor barrier layer; and b. a mass of popcorn in the bag with the popcorn located adjacent the apertures in the microwave shielding layer prior to popping the popcorn;

wherein the bag is initially in a deflated condition, permitting evanescent penetration of the microwave energy sufficient to cause the popcorn to pop, and wherein the bag is subsequently inflated by the water vapor resulting from the popcorn popping, creating a microwave shielded volume interior of the bag to prevent scorching of the popped popcorn in the shielded volume.

21. The microwave popcorn package of claim 20 wherein the bag further includes:

iii. a susceptor located adjacent the mass of popcorn and exposed to microwave irradiation when the bag is placed in an operating microwave oven.

22. The microwave popcorn package of claim 21 wherein the bag further includes:

iv. a septic layer to provide a sanitary environment interior of the bag.

23. A food package for controlling the entry of evanescent microwave energy to the interior of the package comprising:

a. a microwave shielding layer extending over at least a portion of the food package with a plurality of apertures in a predetermined region thereof prior to exposure to microwave energy, with the apertures sized to control evanescent penetration of microwave energy into the interior of the package;

b. a foodstuff contained in the food package with the predetermined region of the microwave shielding layer initially located in close proximity to the foodstuff;

c. means for moving the predetermined region of the microwave shielding layer away from close proximity to the portion of the foodstuff after the package and the foodstuff is irradiated with microwave energy such that the evanescent penetration of the microwave energy through the predetermined region of the microwave shielding layer is insufficient to over heat the foodstuff after the microwave shielding layer is moved out of close proximity to the foodstuff.

24. The food package of claim 23 wherein water vapor is generated by the microwave energy and the means for moving at least the predetermined region of the microwave shielding layer away from close proximity to the foodstuff is a water vapor barrier layer operative to provide relative movement to increase the spacing between the foodstuff and at least a part of the predetermined region of the microwave shielding layer.

25. The food package of claim 24 wherein the foodstuff is popcorn.

26. The food package of claim 23 wherein the food package apparatus further comprises a microwave susceptor.

27. The food package of claim 23 further comprising a septic layer located adjacent the microwave shielding layer.

28. The food package of claim 23 wherein the predetermined region containing the plurality of apertures extends substantially across the entire food package.

29. The food package of claim 23 wherein the predetermined region containing the plurality of apertures includes isolated sub-regions on more than one surface of the food package.

30. The food package of claim 23 wherein the predetermined region is at least congruent to the foodstuff as it exists prior to heating.

* * * * *